US008298263B2

(12) United States Patent
Parker et al.

(10) Patent No.: US 8,298,263 B2
(45) Date of Patent: Oct. 30, 2012

(54) PACIFIER WEANING METHOD AND DEVICE

(75) Inventors: Matthew Parker, Brooklyn, NY (US); Timothy Ramundo, Hartsdale, NY (US)

(73) Assignee: TinkLab, LLC, New York, NY (US)

( * ) Notice: Subject to any disclaimer, the term of this patent is extended or adjusted under 35 U.S.C. 154(b) by 556 days.

(21) Appl. No.: 12/555,941

(22) Filed: Sep. 9, 2009

(65) Prior Publication Data

US 2010/0069959 A1 Mar. 18, 2010

Related U.S. Application Data

(60) Provisional application No. 61/096,341, filed on Sep. 12, 2008.

(51) Int. Cl.
*A61J 17/00* (2006.01)

(52) U.S. Cl. ..... 606/236

(58) Field of Classification Search ..... 215/11.1, 215/11.2, 11.3, 11.4, 11.5, 11.6; 606/234, 606/235, 236; 604/77; D24/194, 195, 196
See application file for complete search history.

(56) References Cited

U.S. PATENT DOCUMENTS

| | | | |
|---|---|---|---|
| 4,153,170 | A | 5/1979 | Aquarian |
| 5,234,117 | A | 8/1993 | Garvin |
| 5,662,684 | A | 9/1997 | Caso |
| D384,748 | S | 10/1997 | Dunn |
| 5,830,235 | A | 11/1998 | Standley |
| 6,041,950 | A | 3/2000 | Soehnlein |
| 6,966,904 | B2 | 11/2005 | Ruth et al. |
| 7,285,127 | B2 | 10/2007 | Jewett |
| D558,354 | S | 12/2007 | Roehrig |
| 7,351,251 | B2 | 4/2008 | Garrett |
| 2002/0065537 | A1 | 5/2002 | Bass |
| 2004/0088005 | A1 | 5/2004 | Boyd |

OTHER PUBLICATIONS

Hazelton, Sydney, "10 Ways to Wean Your Child Off the Pacifier", Feb. 15, 2008, as accessed on Mar. 20, 2012; http://gomestic.com/family/10-ways-to-wean-your-child-off-the-pacifier/2/.*
European Patent Office, Search Report dated Jul. 15, 2010.

* cited by examiner

*Primary Examiner* — Ryan Severson
*Assistant Examiner* — Jonathan W Miles
(74) *Attorney, Agent, or Firm* — Michael J. Feigin, Esq.; Feigin & Associates, LLC

(57) ABSTRACT

The technology disclosed herein provides a device, system, and method for weaning a child off a sucking device, such as a pacifier, by introducing a series of sucking devices with successively smaller nubs. A child is given a first sucking device having a nub of a certain size, and, after a time period, the child is given a second sucking device having a nub smaller than that of the first sucking device. This method may be repeated in multiple iterations, until the child is weaned off sucking devices.

19 Claims, 13 Drawing Sheets

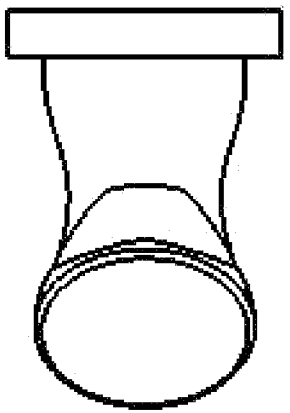
Figure 4A
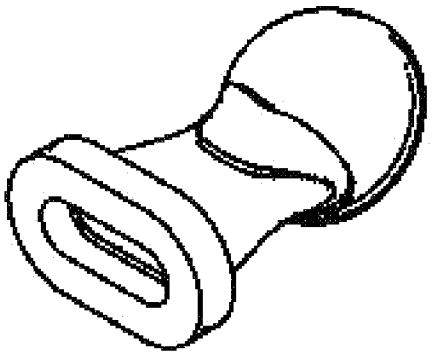
Figure 4B
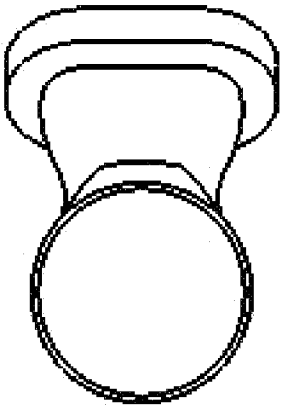
Figure 4C
Figure 4D
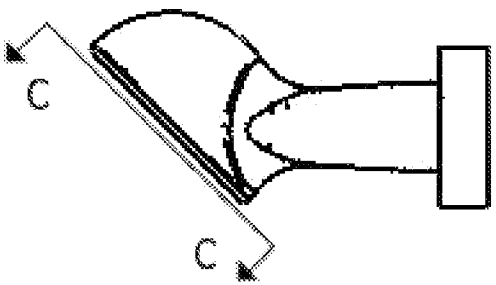
Figure 4E
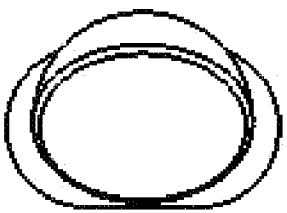
Figure 4F

20

PACIFIER WEANING METHOD AND DEVICE

This Application Claims Priority to Provisional U.S. Pat. No. 61/096,341 Filed Sep. 12, 2008.

FIELD OF THE DISCLOSED TECHNOLOGY

This disclosed technology relates generally to the field of pacifiers and nipples. In particular, embodiments of the present disclosed technology relate to a method and device for weaning an infant or child from the use of pacifiers or nipples.

BACKGROUND OF THE DISCLOSED TECHNOLOGY

Many parents use pacifiers to help soothe babies, infants, and sometimes even toddlers. While there are some drawbacks to using pacifiers, they also have their advantages and remain quite popular. In many cases, a baby may want to suck at non-feeding times, and some studies suggest that pacifier use during napping or sleeping reduces the likelihood of sudden infant death syndrome (SIDS). On the other hand, there are valid reasons that may make it desirable to wean the baby off the pacifier. An increase in ear infections has been linked to pacifier use, and pacifiers may be a source of bacteria; however, the risk of infection is generally lower in the first year of life, making the pacifier a good option at this time, after which it may be advisable wean the baby.

Babies and young children who are dependent on pacifiers often thwart a parent's attempt to withdraw this source of comfort. Unfortunately, the use of a pacifier as a child gets older can lead to health problems, including bacteria-related illness and tooth deformities.

The most commonly used method of weaning a child from the use of pacifiers is to abruptly stop giving the pacifier to the child. This often leads to prolonged episodes of crying by the child and considerable anxiety for the parents. Therefore, weaning a child from the use of a pacifier or a bottle nipple can be an emotional struggle for both the child and the parent. Another known method of weaning involves introducing some roughness to the pacifier surface over time, but this method has limited applications, depending upon the child's tolerance level for roughness versus smoothness.

SUMMARY OF THE DISCLOSED TECHNOLOGY

It is therefore an object of the disclosed technology to provide a weaning device, system, and method for weaning a child off a sucking device, such as a pacifier, by introducing a series of sucking devices with successively smaller nubs (sucking portions).

A method of the disclosed technology comprises a series of sucking devices (such as nipples), each sucking device having a nub wherein the nub is designed for sucking, and each sucking device of the series of sucking devices comprises a nub smaller than that of the preceding sucking device.

In the method of the disclosed technology, a child is given a first sucking device having a nub of a certain size, and, after a time period, the child is given a second sucking device having a nub smaller than that of the first sucking device. This method may be repeated in multiple iterations, whereby the child is given sucking devices having successively smaller nubs over a length of time, until the child is weaned off sucking devices because he or she finds it unsatisfactory to suck on the second or last sucking device given to him or her, or the current sucking device is so small that the child no longer enjoys sucking the device.

The first sucking device of a plurality of sucking devices (such as, of six sucking devices) used in embodiments of the disclosed technology is generally similar in shape, color, size, and/or appearance to the others and/or to a pacifier or other sucking device currently being used by the child, so that the child will be introduced to the weaning system, and the method of the disclosed technology without a major disruption to its routine. Each successive sucking device provided to the child has a nub slightly smaller than the prior nub.

A ring may be provided for removable attachment to the plurality of sucking devices used in the disclosed technology, for the purpose of storing, arranging and keeping the sucking devices together for eventual use.

The first sucking device further includes a mouthpiece to avoid swallowing of the sucking device by the child. A second sucking device in the plurality of sucking devices has a different mouthpiece or the same mouthpiece (differently or similarly sized) as the first sucking device. For example, the mouthpiece size may decrease proportionately to the size of the nub.

The plurality of sucking devices may be color-coded or labeled, such as a label including sequential numbering of the devices from largest to smallest nubs.

BRIEF DESCRIPTION OF THE DRAWINGS

FIGS. 4A through 4F show a third nub used in an embodiment of the disclosed technology.

FIG. 8A is a side elevation view of the mouthpiece in an embodiment of the disclosed technology.

FIG. 8B is a cutaway view along section line H-H of FIG. 8F in an embodiment of the disclosed technology.

FIG. 8C is a front perspective view of the mouthpiece in an embodiment of the disclosed technology.

FIG. 8D is a rear plan view of the mouthpiece in an embodiment of the disclosed technology.

FIG. 8E is a second side elevation view of the mouthpiece in an embodiment of the disclosed technology.

FIG. 8F is a front plan view of the mouthpiece in an embodiment of the disclosed technology.

FIG. 8G is a cutaway view along section line G-G of FIG. 8F in an embodiment of the disclosed technology.

FIG. 9A is a side view of a handle in an embodiment of the disclosed technology.

FIG. 9B is a top perspective view of a handle in an embodiment of the disclosed technology.

FIG. 9C is a top plan view of a handle in an embodiment of the disclosed technology.

FIG. 9D is a side elevation view of a handle in an embodiment of the disclosed technology.

FIG. 9E is a second top plan view of a handle in an embodiment of the disclosed technology.

FIG. 10A is a top plan view of an insert in an embodiment of the disclosed technology.

FIG. 10B is a top perspective view of an insert in an embodiment of the disclosed technology.

FIG. 10C is a side elevation view of an insert in an embodiment of the disclosed technology.

FIG. 10D is a front plan view of an insert in an embodiment of the disclosed technology.

FIG. 10E is a second side elevation view of an insert in an embodiment if the disclosed technology.

FIG. 11A is a top cutaway view along section line J-J of FIG. 11C in an embodiment of the disclosed technology.

FIG. 11B is a side elevation view of a ring of an embodiment of the disclosed technology.

FIG. 11C is a top plan view of a ring of an embodiment of the disclosed technology.

FIG. 11D is a rear elevation view of a ring of an embodiment of the disclosed technology.

DETAILED DESCRIPTION OF THE EMBODIMENTS

Figure 1A:
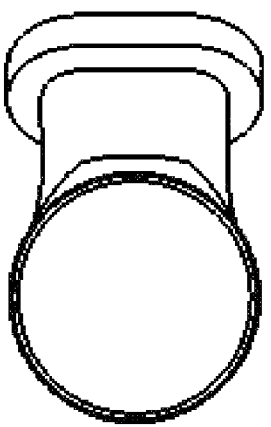
FIGS. 1A through 1F show a series of sucking devices used in an embodiment of the disclosed technology comprising nubs of decreasing size.
Figure 1B:
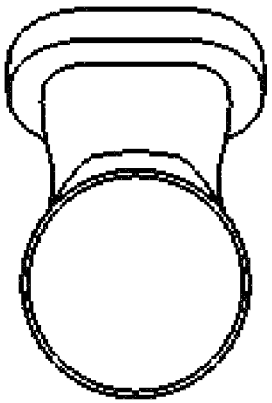
Figure 1C:
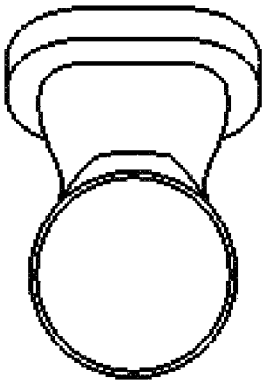
Figure 1D:
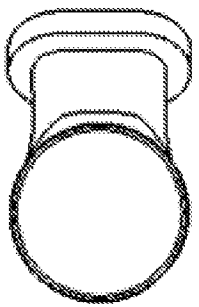
Figure 1E:
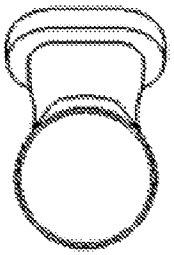
Figure 1F:
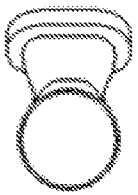
Figure 2A:
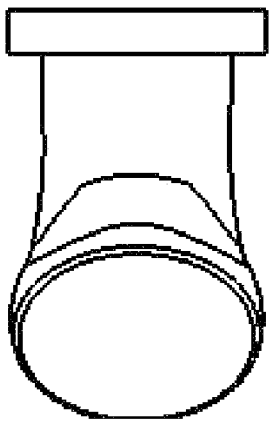
FIGS. 2A through 2F show a first nub used in an embodiment of the disclosed technology.
Figure 2B:
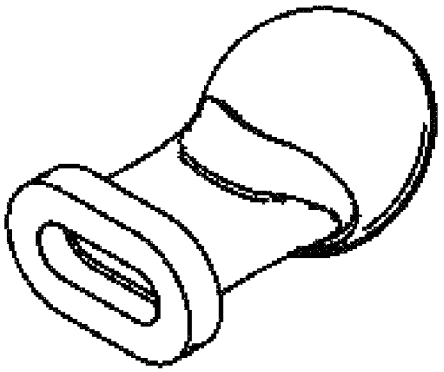
Figure 2C:
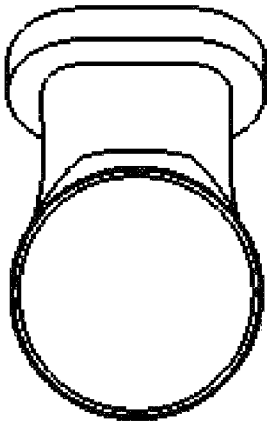
Figure 2D:
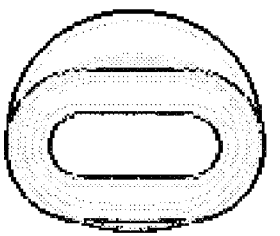
Figure 2E:
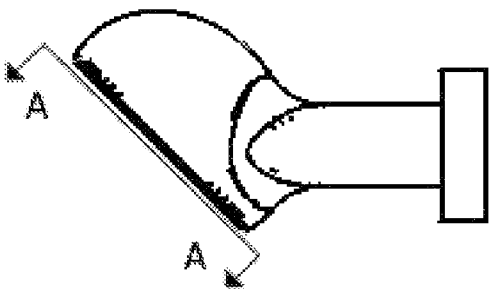
Figure 2F:
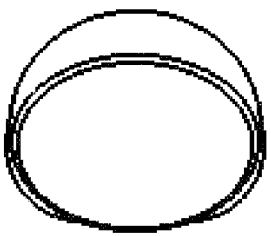
Figure 3A:
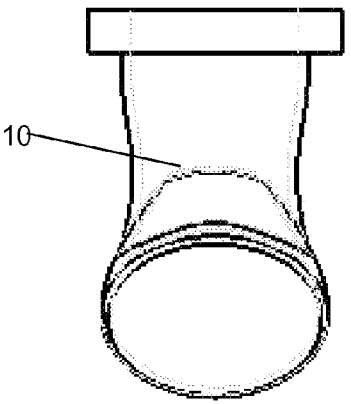
FIGS. 3A through 3F show a second nub used in an embodiment of the disclosed technology.
Figure 3B:
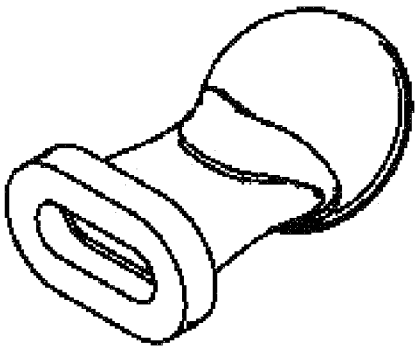
Figure 3C:
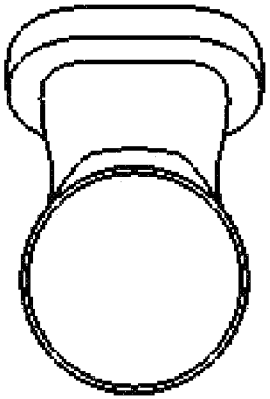
Figure 3D:
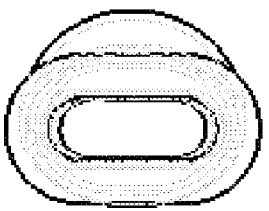
Figure 3E:
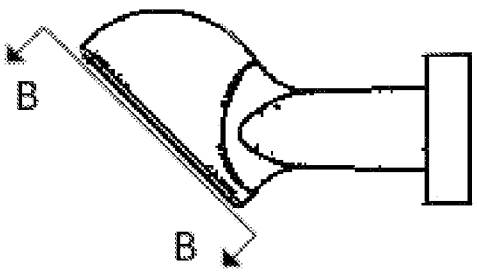
Figure 3F:
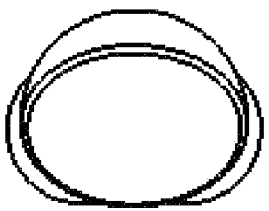
Figure 5A:
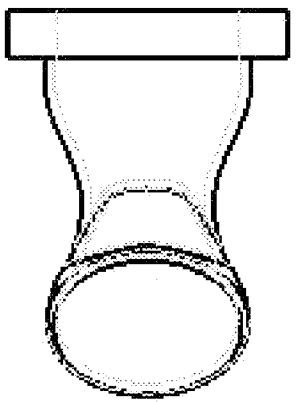
FIGS. 5A through 5F show a fourth nub used in an embodiment of the disclosed technology.
Figure 5B:
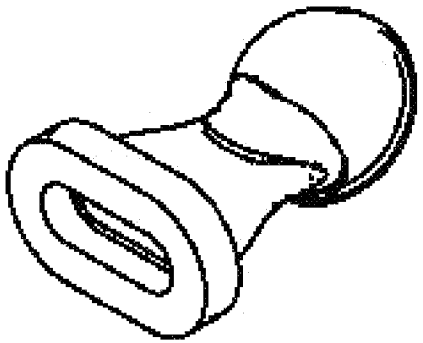
Figure 5C:
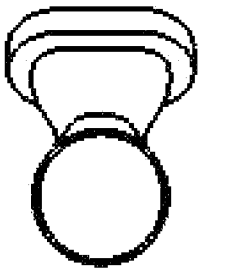
Figure 5D:
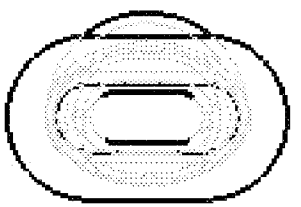
Figure 5E:
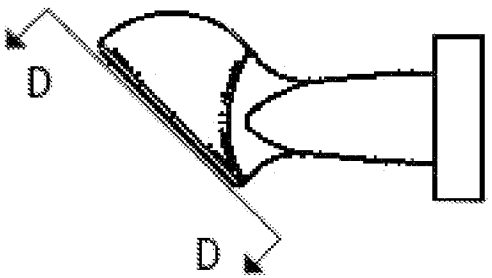
Figure 5F:
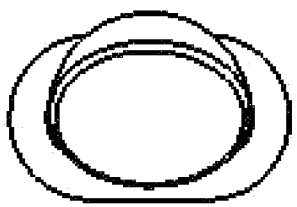
Figure 6A:
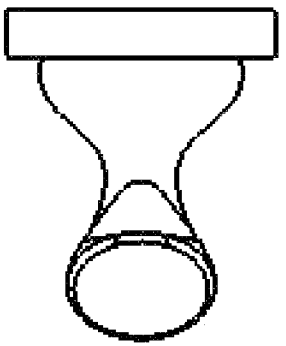
FIGS. 6A through 6F show a fifth nub used in an embodiment of the disclosed technology.
Figure 6B:
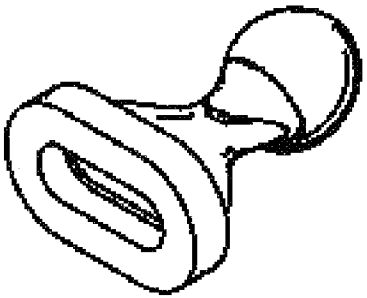
Figure 6C:
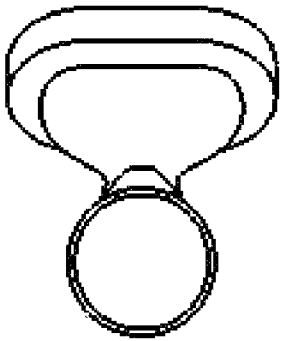
Figure 6D:
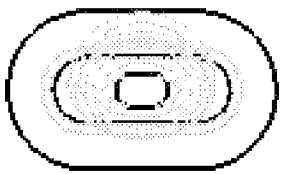
Figure 6E:
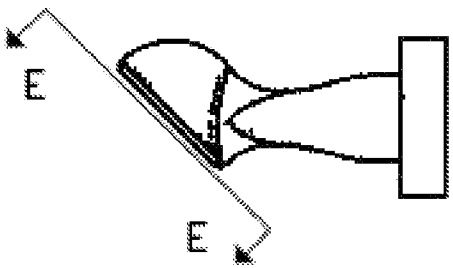
Figure 6F:
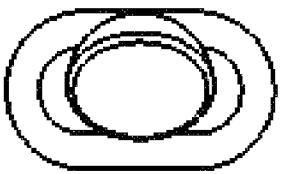
Figure 7A:
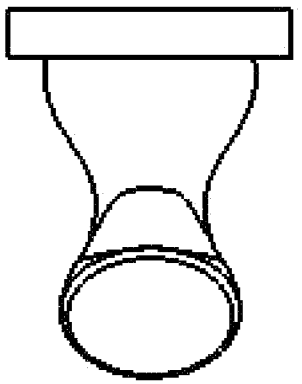
FIGS. 7A through 7F show a sixth nub used in an embodiment of the disclosed technology.
Figure 7B:
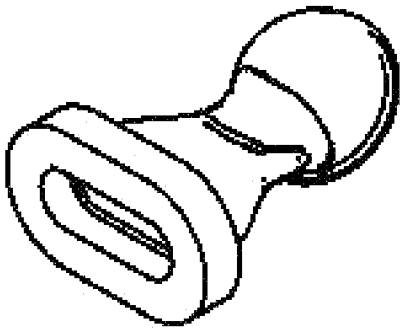
Figure 7C:
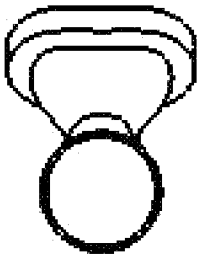
Figure 7D:
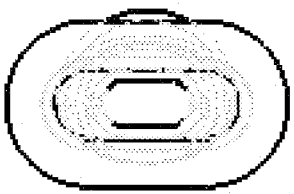
Figure 7E:
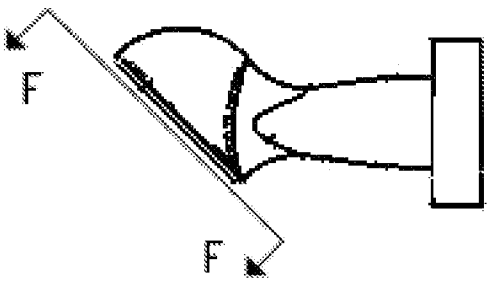
Figure 7F:
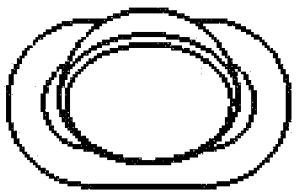

The weaning system of the present disclosed technology involves a series of sucking devices that may be used by children of any age who are dependent on sucking devices for comfort or other reasons. The sucking devices may be pacifier or nipple type devices. The nubs, or end portions, which are adapted for placement inside a child's mouth during sucking, are designed in a series, whereby each successive nub is of a smaller size, such as a smaller radius, area, and/or circumference, than the previous nub. In this manner, it becomes increasingly less satisfying for a child to use a pacifier or bottle sucking device, and the child may be weaned off such sucking devices without such devices being abruptly removed from the child in a harsh or painful manner.

A method of weaning a child off sucking devices, in an embodiment of the disclosed technology, utilizes a plurality of sucking devices in a series. Each sucking device of the plurality of sucking devices comprises an identically-sized mouthpiece and handle. Each successive sucking device comprises a successively smaller nub. For example, six sucking devices are provided in an embodiment of the disclosed technology, numbered 6 through 1. Number 6 is the largest, one is the smallest. A child starts with a sucking device number corresponding to a size closest to the one the child is currently using, which may be any sucking device from number 6 through number 2. So, for instance, they may start with 4 and then go to 3, then to 2, etc. After a period of time, for example, one day, two days, three days, or a week, a parent replaces the presently used sucking device, e.g. number 6 with sucking device number 5 which has a slightly smaller nub. This slow change is physiologically accepted by the child or may not be consciously noticed at all.

After such a period of time, when the child has gotten used to, or completely accepted the new sucking device with smaller nub, as determined by a caregiver or tests indicating how often size changes may be made, a third sucking device is given and the second is taken away. The third sucking device used, for example, number 4 if the child had started with number 6, has a smaller nub than the first two sucking devices, and the process continues. The other factors on the sucking devices may remain constant or may all change. For example, the mouthpiece and handle may remain the same size throughout the set of sucking devices, or may gradually get smaller, relative to the size of the nub.

It should be understood that, in embodiments of the disclosed technology, the child only has in view or uses a single sucking device of the sucking devices in the series described herein. Each previously provided sucking device is hidden from view of the child/user of the sucking devices while the weaning process is being carried out.

The plurality of sucking devices are part of a kit, in an embodiment of the disclosed technology. Such a kit may comprise six sucking devices, a ring adapted for removable attachment with the six sucking devices, instructions for use (e.g., finding the one most similar in size to the presently used sucking device and using the next in a series after every two to three days, etc.), Each sucking device, in embodiments of the disclosed technology, comprises an indicium indicating a relative size of said nub with respect to said nubs of other said sucking devices in said kit, such as a number.

Embodiments of the disclosed technology will become clearer with reference to the following figures.

FIGS. 1A through 1F show a series of sucking devices used in an embodiment of the disclosed technology comprising nubs of decreasing size. FIGS. 2A through 2F show a first nub 10 used in an embodiment of the disclosed technology. FIGS. 3A through 3F show a second nub used in an embodiment of the disclosed technology. FIGS. 4A through 4F show a third nub used in an embodiment of the disclosed technology. FIGS. 5A through 5F show a fourth nub used in an embodiment of the disclosed technology. FIGS. 6A through 6F show a fifth nub used in an embodiment of the disclosed technology. FIGS. 7A through 7F show a sixth nub used in an embodiment of the disclosed technology. While six successively sized nubs to sucking devices (e.g. pacifiers) are shown, it should be clear that any number of sucking devices may be used, such as two, three, four, five, six, or more. Each pacifier of the series is successively smaller in one, or a plurality of, area(s), circumference, radius, and/or other measurements. By way of example, the diameter of the largest pacifier, as shown in FIG. 1A, may be 19.6 mm, and the smallest 11 mm. The diameter is as a measure of distance from extreme ends of the generally spherical end of the nub which enters into a child's mouth. The decrease in size may be linear or exponential, depending on the embodiment. E.g., each decrease in size may be 1.43 mm, or the first decrease may be 0.3 mm, the second, 0.6 mm, the third, 1.2 mm, and so forth. In addition, the decreases may "slow" in the middle, e.g., between the third and fourth iteration, it may be desired to have a smaller decrease than other decreases, so as not to provide smaller nubs too fast and to allow the child a greater adjustment period in the middle, without the need to change the behavior of the parent or caregiver switching the pacifiers at every time interval (e.g., a few days) that passes.

FIGS. 2A, 3A, 4A, 5A, 6A, and 7A are top perspective views of the respective nubs. The end of a nub (the portion that is inserted into a mouth first) decreases in size for each subsequent nub (as displayed in the ordering of the figures). FIGS. 2B, 3B, 4B, 5B, 6B, and 7B are rear perspective views of the respective nubs which may be used to carry out embodiments of the disclosed technology. FIGS. 2C, 3C, 4C, 5C, 6C, and 7C are front perspective views of the respective nubs. FIGS. 2D, 3D, 4D, 5D, 6D, and 7D are front plan views of respective nubs. In the examples displayed, the nubs are transparent to show the proportional dimensions of other components of the nub. For each subsequent sucking device, the end portion increases in size in proportion to an opposite portion.

FIGS. 2E, 3E, 4E, 5E, 6E, and 7E are side elevation drawings of the respective nubs. Each of these figures has a respective sectional line A-A, B-B, C-C, D-D, E-E, and F-F in order, the sectional lines taken at an angle transverse to the longitudinal axis of the nubs. FIGS. 2F, 3F, 4F, 5F, 6F, and 7F are bottom perspective cutaway views of the tip of the respective nubs, cut along the sectional lines A-A through F-F, respectively. The cutaway views shown in FIGS. 2F, 3F, et al., and the sectional lines described therein are along or near the diameter of the bulbous portion of the respective nubs for illustration purposes.

Referring again to FIGS. 2A through 2F, the first pacifier or other sucking device, in an embodiment of the disclosed technology, is a typical pacifier known in the art, so that a baby or small child will feel comfortable using such a pacifier and be unlikely to notice a difference, or will accept the pacifier used in the method and system of the disclosed technology.

FIGS. 3A through 3F show a second nub used in an embodiment of the disclosed technology. It should be noted that the size, as described above, of the nub of this pacifier is slightly smaller. A baby or infant is likely to accept such a change after a period of time, for example, a day, a week, or a few weeks from using the first pacifier. Each successively smaller nub of the pacifiers of FIGS. 4A through 4F may be introduced at a time determined to be optimal by a doctor, parent, or caregiver. The time for changing to a smaller nubbed sucking device may be linear, i.e., the same amount of time for each change, shorter for a smaller change in size or longer for a larger change in size, or may increase or decrease in frequency over time. Factors affecting the decision include the child's acceptance of the new, smaller nubbed sucking device, the child's ability to be pacified by the new smaller nubbed sucking device, urgency of eliminating pacifier use (e.g., the child has tooth problems, ear infections, etc.) and the like.

To decrease the time period that a child is weaning, a nub that is not the smallest nub may be introduced to the child initially. Furthermore, to decrease the amount of time that a child uses a sucking device, a smaller nub may be introduced to a child that is not the sequentially smaller nub. An illustrative example, a caregiver gives her child the pacifier displayed in FIG. 2. The caregiver discovers that the child's teeth are coming in early and wants to accelerate the weaning process. She then gives the child the pacifier displayed in FIG. 4 instead of the pacifier displayed in FIG. 3.

Figure 8A:
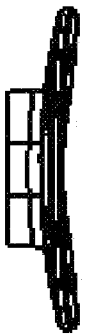
FIGS. 8A through 8G show views of a mouthpiece of a sucking device used in embodiments of the disclosed technology.
Figure 8B:
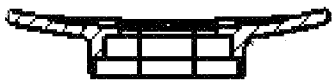
Figure 8C:
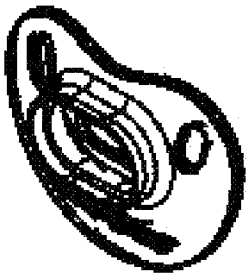
Figure 8D:
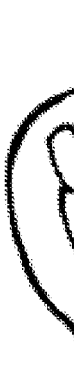
Figure 8E:
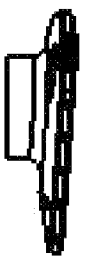
Figure 8F:
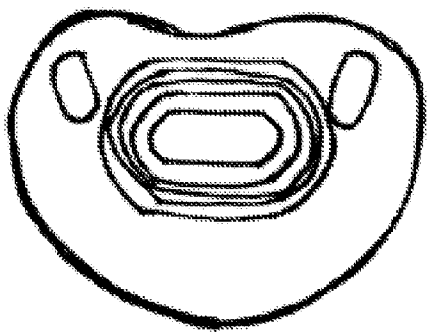
Figure 8G:
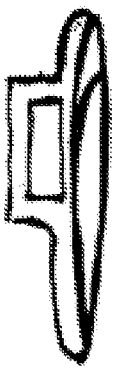

FIGS. 8A through 8G show views of a mouthpiece of a sucking device used in embodiments of the disclosed technology. FIG. 8A is a side elevation view of the mouthpiece in an embodiment of the disclosed technology. FIG. 8B is a cutaway view along section line H-H of FIG. 8F in an embodiment of the disclosed technology. FIG. 8C is a front perspective view of the mouthpiece in an embodiment of the disclosed technology. FIG. 8D is a rear plan view of the mouthpiece 20 in an embodiment of the disclosed technology. FIG. 8E is a second side elevation view of the mouthpiece in an embodiment of the disclosed technology. FIG. 8F is a front plan view of the mouthpiece in an embodiment of the disclosed technology. FIG. 8G is a cutaway view along section line G-G of FIG. 8F in an embodiment of the disclosed technology. The mouthpiece, in embodiments of the disclosed technology, attaches to a nub and remains attached during use of the sucking device. The mouthpiece may be attached by a manufacturer or distributor before the product is sold to a consumer, and the attachment may be permanent or substantially permanent. The mouthpiece prevents the nub from being ingested, as is known in the industry.

Figure 9B:
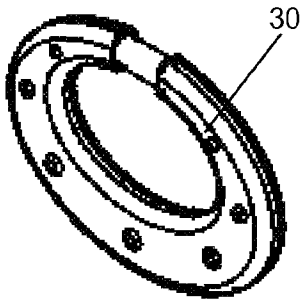
FIGS. 9A through 9E show a ring used in embodiments of the disclosed technology.
Figure 9A:
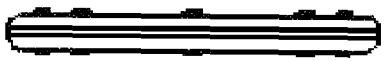
Figure 9E:
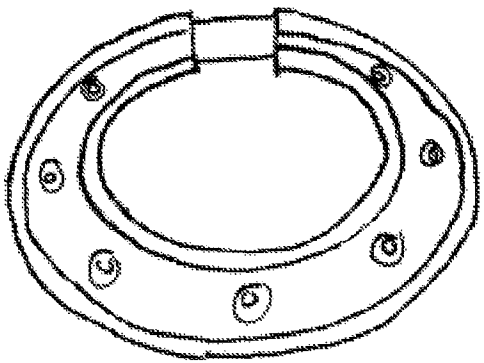
Figure 9D:
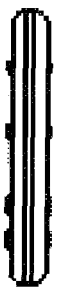
Figure 9C:
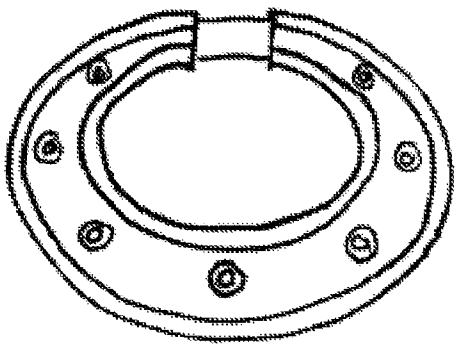

FIGS. 9A through 9E show a ring used in embodiments of the disclosed technology. FIG. 9A is a side view of a handle in an embodiment of the disclosed technology. FIG. 9B is a top perspective view of a handle 30 in an embodiment of the disclosed technology. FIG. 9C is a top plan view of a handle in an embodiment of the disclosed technology. FIG. 9D is a side elevation view of a handle in an embodiment of the disclosed technology. FIG. 9E is a second top plan view of a handle in an embodiment of the disclosed technology. The handle attaches to the mouthpiece directly or by way of an insert (see FIG. 10) and may be via a fixed attachment.

The handle and mouthpiece may be substantially similar/identical for each sucking device of the series of sucking devices. Substantially similar/identical is defined as being indistinguishable to a child using such a device. It may be desired to modify an image, color, or numbered indicia, of the handle and/or mouthpiece, along with the nub, for the purpose of identification (e.g., the order of the pacifiers in the weaning sequence by the caregiver). Such modifications may further include the handle and/or mouthpiece comprising indicia (e.g., a numbering system, images correlating to the sequence of pacifiers provided, etc.) It may further be desired to modify the shape or size of the handles or the mouthpieces to prevent the child from noticing a change in nub size, because the proportional size of the nub compared to the rest of the device remains constant or changes slowly.

Figure 10A:
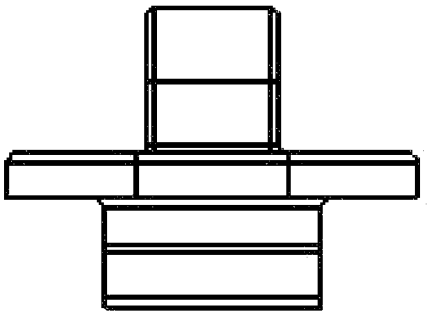
FIGS. 10A through 10E show an insert used in an embodiment of the disclosed technology.
Figure 10B:
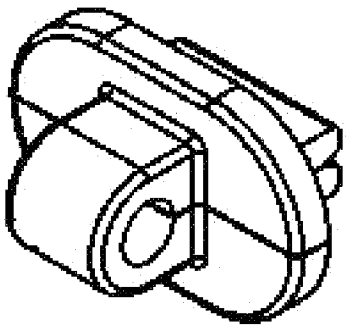
Figure 10C:
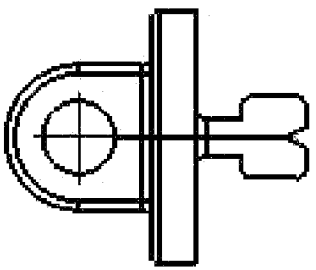
Figure 10D:
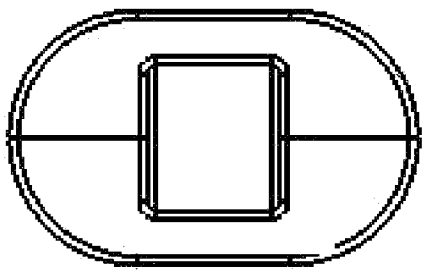
Figure 10E:
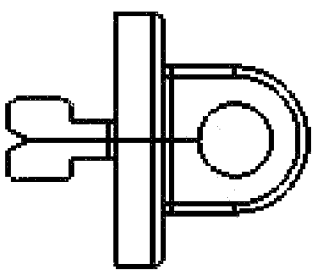

FIGS. 10A through 10E show an insert used in an embodiment of the disclosed technology. FIG. 10A is a top plan view of an insert in an embodiment of the disclosed technology. FIG. 10B is a top perspective view of an insert in an embodiment of the disclosed technology. FIG. 10C is a side elevation view of an insert in an embodiment of the disclosed technology. FIG. 10D is a front plan view of an insert in an embodiment of the disclosed technology. FIG. 10E is a second side elevation view of an insert in an embodiment of the disclosed technology. The insert is used to attach a handle to a mouthpiece.

Figure 11B:
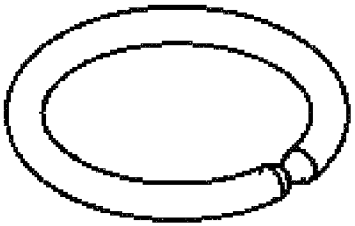
FIGS. 11A-11D show a ring used in an embodiment of the disclosed technology.
Figure 11D:
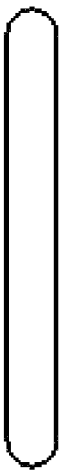
Figure 11A:
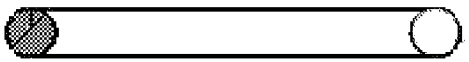
Figure 11C:
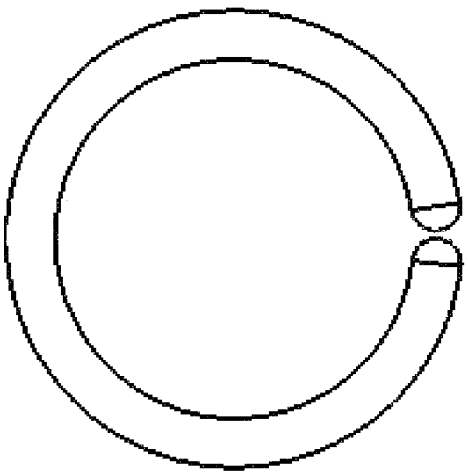

FIGS. 11A-11D show a ring used in an embodiment of the disclosed technology. FIG. 11A is a top cutaway view along section line J-J of FIG. 11C in an embodiment of the disclosed technology. FIG. 11B is a side elevation view of a ring in an embodiment of the disclosed technology. FIG. 11C is a top plan view of a ring in an embodiment of the disclosed technology. FIG. 11D is a rear elevation view of a ring in an embodiment of the disclosed technology. The ring may be used to attach a plurality of sucking devices. The ring, in an embodiment of the disclosed technology, has an opening for attaching the ring-shaped handle of at least one sucking device in a removable manner. In this way, the plurality of sucking devices used in the disclosed technology, which have nubs gradually decreasing in size, may be stored on the ring for convenience, easy removal and addition of each of the sucking devices, as needed.

Figure 12:
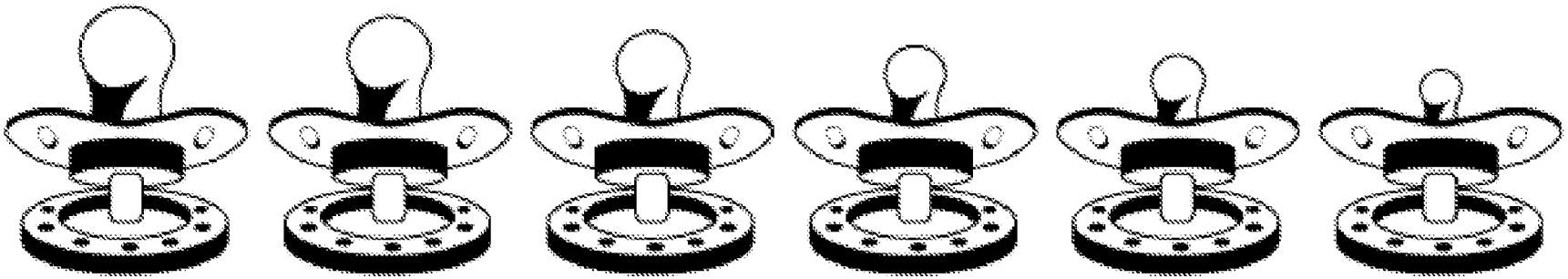
FIG. 12 is a drawing of a series of sucking devices in an embodiment of the disclosed technology.

FIG. 12 shows a series of sucking devices in an embodiment of the disclosed technology. The pacifier nubs decrease in size. Each nub is attached to a respective mouthpiece and handle (as detailed in FIG. 8 and FIG. 9). In further embodiments of the disclosed technology, different nubs may be provided on a single mouthpiece and/or handle.

Figure 13:
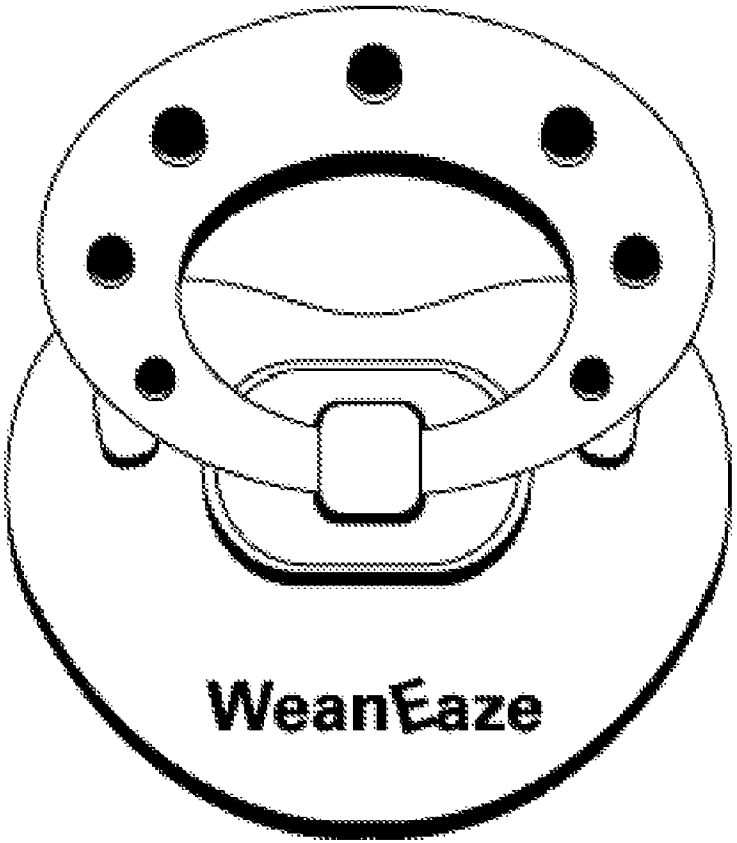
FIG. 13 is a drawing of a front plan view of a sucking device in an embodiment of the disclosed technology.

FIG. 13 shows a front plan view of a sucking device in an embodiment of the disclosed technology. In the figure, the sucking device comprises a mouthpiece, a handle, and an insert, as detailed respectively in FIG. 8, FIG. 9, and FIG. 10.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

We claim:

1. A method of weaning a child off sucking devices; utilizing a plurality of sucking devices in a series, each sucking device of said plurality of sucking devices comprising an identically-sized mouthpiece and handle;

wherein a plurality of said sucking devices is provided and each said successive sucking device comprises a successively smaller diameter of a bulbous portion of a nub, the diameter measured at an angle transverse to the longitudinal axis of the nub.

2. The method of claim 1, wherein six sucking devices are provided.

3. The method of claim 1, wherein a predefined period of time passes between providing successive sucking devices.

4. The method of claim 3, wherein each said period of time is determined based on a time period after the acceptance of a presently provided sucking device.

5. The method of claim 3, wherein said period of time is between two and three days, inclusive.

6. The method of claim 1, wherein, upon providing a said successive sucking device, each previously provided sucking device is hidden from view of a user of said sucking device while said method is being carried out.

7. A kit comprising a plurality of sucking devices, wherein each said sucking device of said plurality of devices comprises a mouthpiece, a handle and a nub, each nub having a successively smaller diameter; wherein said diameter is measured at an angle transverse to the longitudinal axis of said nub.

8. The kit of claim 7, wherein said plurality of sucking devices is comprised of six sucking devices.

9. The kit of claim 7, further comprising a ring and said plurality of sucking devices which are adapted for removable attachment to said ring.

10. The kit of claim 7 wherein each sucking device of said plurality of sucking devices comprises an indicium indicating a relative size of said nub with respect to said nubs of other said sucking devices in said kit.

11. The kit of claim 10 wherein said indicium is a number.

12. The kit of claim 10, where said indicia are sequential numbers and a highest said number is placed on a sucking device with a largest said nub.

13. The kit of claim 7 wherein each said mouthpiece is successively smaller, corresponding to the successively smaller nubs.

14. The kit of claim 7, wherein each said mouthpiece is of a single size.

15. The kit of claim 7, further comprising instructions, said instructions indicating a method of use comprising use of successively smaller nubs every two to three days, inclusive.

16. The kit of claim 7, wherein said sucking device with said smallest said nub is the last sucking device to be used said child of said plurality of sucking devices.

17. The kit of claim 7, wherein each said sucking device further comprises a handle.

18. The kit of claim 17, wherein said handle is adapted for engagement with said ring.

19. The kit of claim 7, wherein said plurality of sucking devices comprises at least four sucking devices.

* * * * *